United States Patent [19]

Takai

[11] 4,047,373

[45] Sept. 13, 1977

[54] FALSE-TWISTING METHOD AND APPARATUS FOR PRODUCING CRIMPED FILAMENT YARNS

[75] Inventor: Isao Takai, Komatsu, Japan

[73] Assignee: Oda Gosen Kogyo Kabushiki Kaisha, Komatsu, Japan

[21] Appl. No.: 698,778

[22] Filed: June 22, 1976

[30] Foreign Application Priority Data

| | | |
|---|---|---|
| June 24, 1975 | Japan | 50-76854 |
| June 24, 1975 | Japan | 50-76855 |
| July 23, 1975 | Japan | 50-89210 |
| Nov. 25, 1975 | Japan | 50-140289 |

[51] Int. Cl.[2] ..... D02G 1/06; D01H 7/92

[52] U.S. Cl. ..... 57/77.4; 57/157 TS

[58] Field of Search ..... 57/34 R, 77.3–77.45, 57/156, 157 TS

[56] References Cited

U.S. PATENT DOCUMENTS

| | | | |
|---|---|---|---|
| 2,262,589 | 11/1941 | Peck | 57/77.4 X |
| 2,908,133 | 10/1959 | Brown | 57/77.4 |
| 3,045,416 | 7/1962 | Ubbelohde | 57/77.45 |
| 3,156,084 | 11/1964 | Van Dijk et al. | 57/77.4 |

FOREIGN PATENT DOCUMENTS

| | | | |
|---|---|---|---|
| 4,914 | 7/1902 | Denmark | 57/77.4 |
| 139,003 | 1/1903 | Germany | 57/77.4 |

*Primary Examiner*—Donald Watkins

*Attorney, Agent, or Firm*—Cushman, Darby & Cushman

[57] ABSTRACT

A method and an apparatus for producing crimped filament yarns, said apparatus comprising at least one first twister member and at least one second twister member, each of said twister members having a work surface made of a synthetic rubber having a relatively small friction coefficient therebetween. These twister members are arranged so that their work surfaces cross each other at a selectable angle in contact relationship to provide at least one crossing zone for nipping therebetween at least one thermoplastic filament yarn which is fed to twist this filament yarn between the contacting work surfaces successively and at the same time to urge this filament to discharge from this crossing zone successively as the twister members are driven. This method and apparatus allow filament yarns to be imparted desired false-twisting effect, practically without being damaged and without causing uneven twists, at a high operation rate of 800 – 1000 meters per minute.

24 Claims, 9 Drawing Figures

FALSE-TWISTING METHOD AND APPARATUS FOR PRODUCING CRIMPED FILAMENT YARNS

BACKGROUND OF THE INVENTION a. Field of the Invention

The present invention concerns a method and apparatus for performing false-twisting of filament yarns to produce crimped filament yarns.

b. Description of the Prior Art

Conventional false-twisting apparatuses may be divided roughly into the following two types, one of which is the so-called spindle system type and the other may be termed as the friction system type.

The known false-twisting apparatuses of the spindle type may further be divided into the two sub-types, one of which is arranged so that the spindle is contact-driven by a drive roller made of rubber. In actual operation of this type of apparatus, the spindle is rotated usually at the rate of the order of 350,000 – 450,000 r.p.m. at the most. In view of the fact that the velocity of travel of the filament yarn which is being processed is determined in proportion to the rotation speed of the spindle, the productivity of the aimed crimped filament yarn, accordingly, is determined by the rotation speed of the spindle, and no further improvement in the productivity can be expected beyond this level unless the rotation speed of the spindle is increased. Moreover, those spindles which are employed in the conventional false twisters of this type are such that their twister pins are heated due to the friction produced by the drive rollers. In addition, the filament yarn which is heated to produce crimps therein is passed therethrough while being rotated axially. Therefore, the twister pin is subjected to further heating and the temperature thereof inconveniently increases higher to a level above the secondary transfer point of the original filament yarn.

The other type of the false-twisting apparatus of the prior art which employs the spindle system is represented by an apparatus comprising a turbine-blade type high speed rotary member having blades formed on its outer periphery and having a filament yarn passageway formed axially therethrough and a twister pin provided in this passageway, said rotary member being supported by fluid-bearing within a casing, said rotary member further comprising means for jetting a pressurized fluid onto the blades of said rotary member. During the operation, the twister pin is cooled indirectly by said pressurized fluid to prevent an elevation of the temperature of the twister pin. The apparatus of this type allows the productivity of crimped yarn which is almost doubled as compared with that of the first-mentioned type. However, according to such known type of false-twisting apparatus, the processing speed, as measured in terms of the running speed of the filament yarn, is 100 m/min. ~ 150 m/min. at the most. Above this level, the filament yarns which are subjected to a false-twisting process tend to develop a number of hair or fluffs and breakage of filament yarns resulting in rejectable yarns.

In the false-twisting apparatuses of these known types, it is mandatory that the pull-out tension of the filament yarn has to be greater than the tension of the filament yarn located on the twisting zone. In order to raise productivity, the spindle which is required one for each filament yarn has to be rotated at a ultra-high speed and also the pull-out tension is required to be increased. However, with an increase in the pull-out tension which is applied onto the filament yarn to be processed, there suddenly arises an increase in the number of development of hair or fluffs in the filament yarns and the number of broken yarns, so that no crimped filament yarns of the desired good quality can be obtained.

As stated previously, there have been proposed various types of false-twisting apparatuses of the so-called friction type. Apparatuses of this type of the prior art employ either at least two belts having their working surfaces arranged to frictionally engage a filament yarn successively during the run of these belts in opposite directions, said working surfaces of the belts having a large friction coefficient; or the apparatuses employ frictionally engaging rotary members such as rigid disks or conically-shaped rotary members having spiral row of ridges formed on the surfaces of these rotary members. In each of these two kinds of apparatuses, a filament yarn is fed between the surfaces of the frictional running disks or rotary members for engagement with these two surfaces of the running rigid disks or rotary members for contact therewith to be twisted thereby. While the false-twisting apparatuses relying on the surface friction system allow a higher processing rate as compared with the spindle type apparatuses, the filament yarns are, as stated above, twisted by the friction force between the filament yarns and the high friction members, and thus there is required a certain amount of tension for twisting operation. As compared with the false twisting operation of the spindle type wherein a filament yarn is turned once around the twisting pin to insure an unfailing twist, the friction system is poor in the processing efficiency such that there easily develops "stick slip" between the filament yarn and the high friction members, resulting in the development of portions of uneven twists which, in turn, tend to cause non-twisted portions remaining in the crimped filament yarns produced. Along therewith, according to the false twisting system relying on the friction system, the tension applied on to the filament yarn in the de-twisting zone, i.e. in the zone where the filament yarns are delivered from the twisting apparatus, increases with an increase in the processing rate, i.e. the running speed of the filament yarns. For this reason, the operation is accompanied by the tendency to develop breakage of the filament yarns and development of hair or fluffs in the filament yarns during the false-twisting operation, causing a reduction in the productivity and the lowering of the quality of the products. Thus, according to the apparatuses of the friction type, the maximum limit of practical processing rate is the order of 500 – 600 meters per minute. Furthermore, the number of twists or turns imparted to the filament yarn in such known type of false-twisting apparatuses is knwon either by sampling the running filament yarn and by measuring the number of the actual turns thereof or by just an inference alleging from the tension applied to the filament yarn being twisted by giving reference to the predetermined mutual relationship between the actual turns and the tension applied onto the filament yarn at the time of twisting. Thus, in the prior art, it is difficult to make accurate control of the number of turns imparted to the filament yarns being processed.

As still another type of known friction-type false twisting apparatus, there is one comprising two rotary disks each having a ridge of ring shape provided on the circumference thereof, said rotary disks being brought into contact with each other, with the centers of these two rotary disks being offset relative to each other, so that a filament yarn is fed through the site of contact of these two rotary disks for being twisted. With such known false twisting apparatus, it will be noted that, in order to have a filament yarn nipped positively between the two rotary disks, there is required a relatively great pressure of contact between the two rotary disks. This, in turn, tends the ridged portions of the rotary disks to become easily worn out, so that it is difficult to perform false twisting of a filament yarn with stability throughout the twisting operation.

In order to avoid such wear-out of the rotary disks, there has been proposed to pass a bundle of yarns between a pair of belts which are spaced from each other with a narrow distance therebetween. It has been noted however, that with such an apparatus, it is difficult to have a fine filament yarn nipped between such pair of belts. Thus, it is not possible to perform a stabilized false twisting operation.

SUMMARY OF THE INVENTION

It is, therefore, an object of the present invention to provide a method and an apparatus of the nipping type for performing false-twisting of filament yarns at a high speed without the accompaniment of the drawbacks of the prior art.

Another object of the present invention is to provide a method and an apparatus of the type described above, which is arranged so that the filament yarn subjected to a false twisting process is nipped when it is twisted and that the twisting of the filament yarn and the discharging of the twisted yarn from the twisting zone are carried out simultaneously.

Still another object of the present invention is to provide a method and an apparatus of the type described above, which allow the operation of false twisting to be carried out with stability for an extended period of time.

Yet another object of the present invention is to provide an apparatus of the type described above, which is simple in structure and is manufactured at a low cost.

These and other objects as well as the features and advantages of the present invention will become apparent by reading the following detailed description of the present invention with respect to preferred examples when taken in conjunction with the accompanying drawings.

DETAILED DESCRIPTION OF THE PREFERRED EMBODIMENTS

The false twisting method according to one aspect of the present invention for producing crimped filament yarns comprises preparing at least two power-driven belts forming a pair, each of the belts being made with a material to have a working surface of small surface friction coefficient between the two work surfaces, said two belts being driven to run so as to have straightly extending regions during their courses of run and in such a way that these straightly extending regions cross each other at a selected angle during their run and that their work surfaces come into contact with each other at the site of their crossing, said method further comprising feeding at least one filament yarn through the contact zone of these straightly extending regions of the running belts in such a manner that this filament or filaments are nipped progressively between the work surfaces of these two said regions of the two belts in said pair as the belts are driven to run, thereby twisting the filament yarn or yarns and along therewith urging the filament yarn or yarns to advance progressively through the nipping zone of the running belts toward the outside of this zone.

The apparatus employed for materializing said method of the present invention comprises at least two endless belts forming a pair, each of the paired belts being made with a material to have a work surface of a small surface friction coefficient between the two work surfaces thereof. These two belts of the pair are driven to run in such a way that they have straightly extending regions, respectively, during their courses of run and that these straightly extending regions of the two paired belts cross each other at a selected angle during their run and that the work surfaces of the belts come into contact with each other at the site of their crossing. At least one thermoplastic filament yarn is fed through the contact areas of the straightly extending regions of these running belts, in such way that the filament yarn travels through the angle region defined between the straightly extending regions of the belts in their respective directions of run. The filament yarn is thus nipped progressively of its length between the successively contacting work surfaces of the running belts. As the belts run, the nipped filament yarn is twisted progressively along its length and is urged to advance successively from the nipping zone. Thus, the filament yarn is imparted a desired false twisting effect in the nipping zone and at the same time therewith it is urged to advance successively therefrom.

Figure 1:
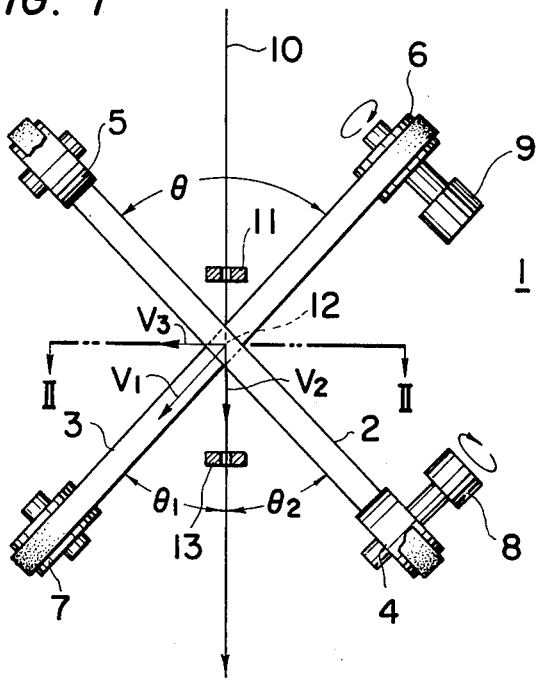
FIG. 1 is a somewhat diagrammatic representation of the essential portions of the false-twisting apparatus according to the present invention, with associated driving portions of the apparatus being omitted.
Figure 2:
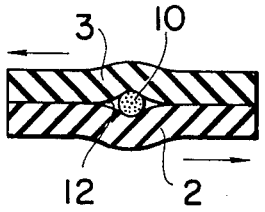
FIG. 2 is a cross sectional view taken along the line II — II in FIG. 1.

Referring now to FIG. 1 which shows an example of the present invention, the principle of the present invention will be explained in further detail. The false twisting apparatus generally indicated at 1 comprises two endless flat surfaced belts 2 and 3, forming a pair, which are made of, for example, a synthetic rubber to have work surfaces, respectively, of a small friction coefficient therebetween. These endless belts 2 and 3 are supported on pulleys 4, 5 and 6, 7, respectively, so as to provide straightly extending regions between their respective associated pulleys. These belts 2 and 3 are driven in different directions indicated by the arrows shown, by means of drive pulleys 8 and 9, respectively. These drive pulleys are driven synchronously through, for example, synchronous motors not shown, to insure that the belts 2 and 3 are caused to run in their own directions at the same surface velocity. As shown in FIG. 2, these two endless belts 2 and 3 thus travel in different directions at a predetermined angle at the same speed while their surfaces come into contact with each other successively at the site of their crossing.

A filament yarn 10 which may be, for example, a thermoplastic synthetic filament yarn is subjected to heating, upstream of the false twisting apparatus 1, by a heating unit not shown, and via an inlet guide 11, the filament yarn 10 is passed progressively through the region of an angle $\theta$ which is defined between the straightly extending regions of the two endless belts 2 and 3 which travel in different directions. Therefrom, the filament yarn 10 enters progressively into the twisting zone, i.e. between the contacting surfaces of the crossing straightly extending regions of the two running belts 2 and 3, where the filament yarn 10 is twisted while being nipped successively along its length between these contacting surfaces of the running belts 2 and 3, while being urged, at the same time, to be discharged successively from the nipping zone. Therefrom, the filament yarn which is now set free to be untwisted loose is taken onto a take-up device not shown via an outlet guide 13.

As shown in FIG. 1, the directions of these two endless belts 2 and 3 are set at an angle which is 90° or smaller relative to the direction of travel of the filament yarn 10, according to this example. Therefore, the endless belts 2 and 3 not only serve to carry out the twisting of the filament yarn 10 but also to impart this filament yarn 10 a successive advancing action which is a pull tension applied to this filament yarn. More specifically, let us now assume that the running velocity of the belts throughout the apparatus is designated as $V_1$, and that the angle defined between this belt 2 and the filament yarn 10 is designated as $\theta_1$, then the feed velocity $V_2$ which is imparted to the filament yarn 10 will be:

$$V_2 = V_1 \cos\theta_1$$

Figure 3:
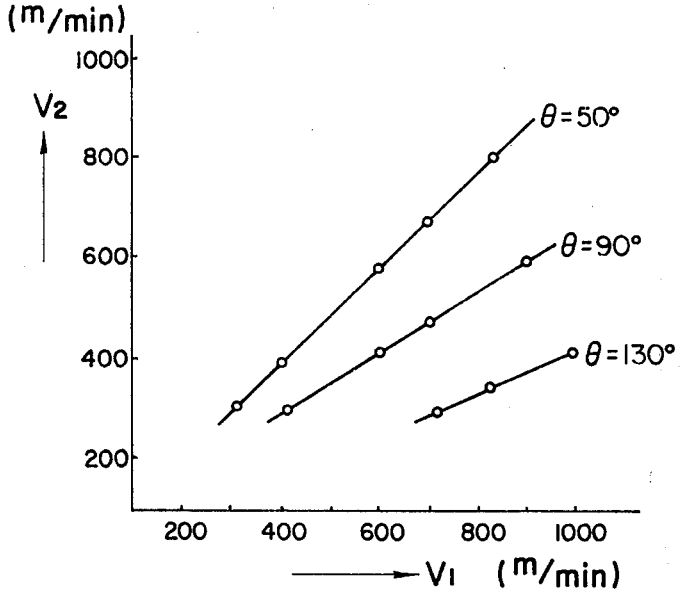
FIG. 3 is a chart showing the relationship between the velocity $V_1$ of the running belts which perform twisting of the filament yarn and the velocity of the feeding action $V_2$ which is imparted to this filament yarn by these belts.

Same principle can be applied to the belt 3. As will be described later, the false twisting apparatus 1 according to the present invention can be constructed in such a way that the angle between the filament yarn 10 and the straightly extending regions of the belts 2 and 3 is allowed to be varied as required. By varying this angle to a desired value, the feed velocity of the filament yarn 10 can be varied to a desired value. It should be understood that the respective angles $\theta_1$ and $\theta_2$ defined between the filament yarn 10 and the respective straightly extending regions of the two belts 2 and 3 most preferably are adjusted to establish the relationship of $\theta_1 = \theta_2$ from such viewpoint as the stability for feeding the filament yarn. FIG. 3 shows the relationship between the surface velocity $V_1$ (m/min.) of the belts 2 and 3 and the feed velocity $V_2$ (m/min.) of the filament yarn which is developed as a natural result of the running of these belts, said relationship being expressed in terms of the angle formed between the belts and the filament yarn.

As stated above, according to the false twisting method of the present invention, the filament yarn 10 is imparted with a feed action while it is being nipped by the straightly extending regions of the belts 2 and 3 at their crossing areas. Therefore, by arranging so that the above-said feed velocity $V_2$ caused by the running belts 2 and 3 is in agreement with the processing velocity V which is determined by the feed rollers not shown which are provided upstream of the apparatus and by the take-up rollers not shown which are provided downstream of the apparatus, or in other words, by adjusting the velocities to establish the relation: $V_2 = V$, the filament yarn 10 can be false-twisted with no difficulty whatsoever. Thus, it becomes possible to effect a ultra-high speed operation, for example the false-twisting operation at the rate of 800 - 1000 m/min. of the travel speed of the filament yarn, without causing any damage or uneven twists in the filament yarn being processed.

Furthermore, according to the false-twisting method of the present invention, the filament yarn 10 is subjected to false twisting process in the state of this filament yarn being nipped between the crossing and contacting straightly extending regions of two running belts, it should be understood that, unlike the prior false twisting methods utilizing contact friction system wherein it is not possible to properly know a desired number of turns imparted to the filament yarn being processed, accurate number of turns can be known from the theoretical formulas as will be mentioned below.

More specifically, in the false twisting apparatus according to the present invention, let us now assume that the surface speed of the straightly extending regions of the running belts 2 and 3 is designated as $V_1$; the velocity which is imparted to the filament yarn 10 caused by the running and nipping belts 2 and 3, i.e. the velocity of the filament yarn delivered from the false twisting apparatus, is designated as $V_2$; the horizontal twisting velocity caused by the running belts 2 and 3 is designated as $V_3$; the angle defined by the straightly extending regions of the belts 2 and 3 is designated as $\theta$; and the angles $\theta_1$ and $\theta_2$ between the filament yarn 10 and the respective straightly extending regions of the belts 2 and 3 as $\theta_1 = \theta_2 = \theta/2$, there is established the following relationship:

$$V_2 = V_1 \cos\theta/2 \quad (1)$$

$$V_3 = V_1 \sin\theta/2 \quad (2)$$

Also, the cross sectional area of the filament yarn 10 is expressed by the following formula:

$$\pi r^2 = de \times 10^{-6}/0.9 \times \rho \ (cm^2)$$

wherein:

*de* represents the denier of the filament yarn being processed;

*r* represents the radius of this filament yarn; and $\rho$ represents the specific gravity of this filament yarn.

From the above-mentioned formula is obtained the radius *r* as follows:

$$r = 5.95 \times 10^{-4} \times \sqrt{de/\rho} \ (cm).$$

The diameter of the filament yarn is expressed from the above equation as follows:

$$D = 1.19 \times 10^{-5} \times \sqrt{de/\rho}\ (m) \quad (3)$$

Now, the number of turns $Y_{rpm}$ of the filament yarn 10 per se when this filament yarn is turned due to the running straightly extending regions of the belts 2 and 3 will be expressed by the following equation:

$$Y_{rpm} = \frac{V_3}{\pi \cdot D} = \frac{V_1 \sin\frac{\theta}{2}}{\pi \times 1.19 \times 10^{-5} \times \sqrt{de/\rho}} \quad (4).$$

Therefore, the number of turns N per meter is expressed as follows:

$$N = \frac{Y_{rpm}}{V_2} = \frac{\tan\frac{\theta}{2} \times \sqrt{\rho}}{\pi \times 1.19 \times 10^{-5} \times \sqrt{de}} \quad (5).$$

Thus, it will be understood that the number of turns of the filament yarn 10 will vary by varying the angle $\theta$ of the filament yarn relative to the straightly extending regions of the belts 2 and 3. Now, in order to obtain a number of turns for the respective filament yarns which are made of different materials, respectively, the following Table 1 may be utilized:

Table 1

| Material | $\rho$(specific gravity) | Number of turns (T/m) |
|---|---|---|
| Polyester | 1.38 | $31423 \times \frac{\tan\frac{\theta}{2}}{\sqrt{de}}$ |
| Nylon | 1.14 | $28560 \times \frac{\tan\frac{\theta}{2}}{\sqrt{de}}$ |
| Acryl | 1.17 | $28933 \times \frac{\tan\frac{\theta}{2}}{\sqrt{de}}$ |
| Diacetate | 1.32 | $30732 \times \frac{\tan\frac{\theta}{2}}{\sqrt{de}}$ |

Figure 4:
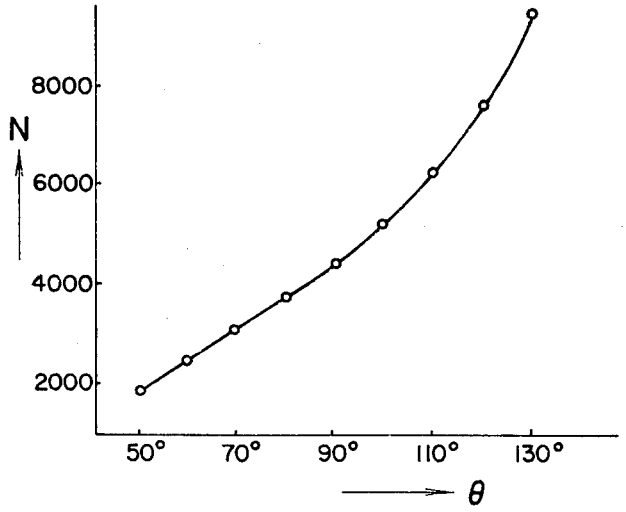
FIG. 4 is a chart showing the relationship between the angle $\theta$ defined by the crossing belts and the number of turns N which is imparted to the filament yarn by these crossing belts.

As an example of the number of turns of a filament yarn obtained from the above-mentioned Table 1, there will be mentioned the number of turns of a polyester filament yarn in Table 2. Also, the variation of the number of turns N of a polyester filament yarn of 50 denier will be mentioned in chart as in FIG. 4.

Table 2

| $\theta$ de | 20 | 30 | 50 | 75 | 100 | 150 | 200 | |
|---|---|---|---|---|---|---|---|---|
| 100° | 8375 | 6839 | 5297 | 4325 | 3745 | 3059 | 2649 | (per/m.) |
| 95 | 7665 | 6259 | 4848 | 3958 | 3428 | 2800 | 2424 | " |
| 90 | 7026 | 5737 | 4444 | 3628 | 3142 | 2566 | 2222 | " |
| 85 | 6436 | 5255 | 4071 | 3323 | 2878 | 2350 | 2035 | " |
| 80 | 5895 | 4813 | 3729 | 3044 | 2636 | 2153 | 1864 | " |

As stated above, according to the method of the present invention, it is possible to make an exact control of the number of turns of the filament yarns as is possible also with the spindile type false twisting method.

In a false twisting method, as in the present invention, wherein two twister members are caused to travel in different directions relative to each other while coming into contact with each other successively and nipping a filament yarn or yarns between the successively contacting zone of the twister members, there will arise the problem of wear of these twister members. The wear of these twister members greatly depends on the pressure of contact between the two twister members and also on the friction coefficient between these twister members.

The author has discovered that, in case endless belts are employed as in this invention as the twister members in place of rigid disks, the work surfaces of these endless belts possess such resiliency as will be able to displace somewhat in a direction substantially perpendicular to the surface planes of these belts and to exhibit flexibility against the force applied to the surfaces of the belts in a direction substantially perpendicular to the surface plane of each of these belts, unlike the instance where rigid disks are employed, and that accordingly a sufficient nipping action can be obtained from the straightly extending regions of the belts even at a relatively small pressure of contact of these regions of the belts, such as 300 grams or less or even 100 grams or less.

In the known false twisting apparatuses of the friction type, there are generally employed twister members having a large surface friction coefficient therebetween in order to enhance the twisting action of the belts. The author, contrariwise, has discovered that the use of twister members, such as belts, which have a relatively small surface friction coefficient therebetween is desirable. The reasons therefor will be explained as follows. In case twister belts having highly frictional surfaces are employed, there is produced heat on the surfaces of these belts as they travel. As a result, the surfaces of the belts will begin to exhibit an excessive stickiness so that the belts will become more and more difficult to travel smoothly. Thus, there can arise the fear that the belts come off the pulleys around which the belts are applied. From such viewpoints as stated above, it has been found by the author that the intrasurface friction coefficient $\mu$ of the belts which are employed in the present invention desirably is in the condition: $\mu < 0.5$, and preferably $0.1 < \mu < 0.4$, and more preferably $0.2 < \mu < 0.3$.

Figure 5:
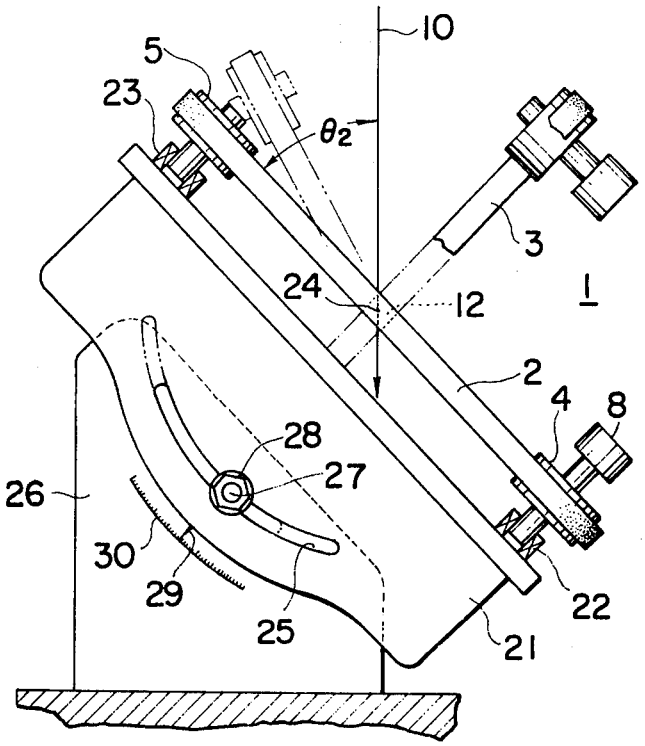
FIG. 5 is a somewhat explanatory diagrammatic representation of an example of the structure for supporting the belts used for twisting a filament yarn, which belts being shown in FIG. 1.

FIG. 5 is an explanatory illustration of the supporting mechanism 20 for supporting the twister belts 2 or 3 shown in FIG. 1. It should be understood that the supporting mechanism for supporting the belt 2 shown in FIG. 1 is either identical with or equal to the supporting mechanism for supporting the belt 3. Accordingly, in FIG. 5 is shown briefly only the supporting mechanism for the twister belt 2 for the sake of simplicity. The rotary shaft of the pulley 4 is supported on a bearing 22 provided on a supporting frame 21. On the other hand, the rotary shaft of the pulley 5 is supported on a bearing 23 which is provided on the same supporting frame 21. Th bearing 23 is movably mounted on the upper surface of the supporting frame 21 to enable an adjustment of the tension of the twister belt 2. On the supporting frame 21 is provided an arcuate guide slot 25 having its center located at the center of the crossing plane 12 defined by the work surfaces of the crossing belts 2 and 3. Whereas, a bolt 27 extends from a fixed frame 26 whose forward end portion loosely passes through said arcuate guide slot 25, and a nut 28 is screwed onto the end portion of this bolt 27. Also, an indicator needle 29 is provided on the supporting frame 21, whereas graduations 30 are formed on the fixed frame 26 so as to correspond to the indicator needle 29 of the supporting frame 21. More specifically, by screwing the nut 28 tightly onto the bolt 27, the supporting frame 21 is maintained in its state of being fixed to the fixed frame 26.

However, as the nut 28 is loosened or unscrewed progressively, the supporting frame 21 will become allowed to move, within the range of the guide slot 25, relative to the fixed frame 26. Therefore, in case there arises the need to change or adjust the angle $\theta_2$ of introduction of the filament 10 in FIG. 5, or for example when there is the need to make $\theta_2$ smaller, this purpose is accomplished by first unscrewing the nut 28 to thereby turn the supporting frame 21 clockwise about the center 24 of the crossing plane 12 of the two belts 2 and 3. Then, while watching the graduations 30 provided on the fixed frame 26, when the indicator needle 29 arrives at the desired position on the graduations 30, the nut 28 is tightly screwed onto the bolt 27 at such desired position. Thus, the supporting frame 21 can be fixed to the fixed frame 26. In FIG. 5 is shown only partly by two-dots chain lines the state in which the supporting frame 21, and accordingly the pulleys 23 and 22 carried thereon, has been moved to a position different from the initial position shown in solid lines. Also, in case it is required to have a large value of $\theta_2$, it is only necessary to rotate the supporting frame 21 counterclockwise in a manner similar to that described above.

Figure 6:
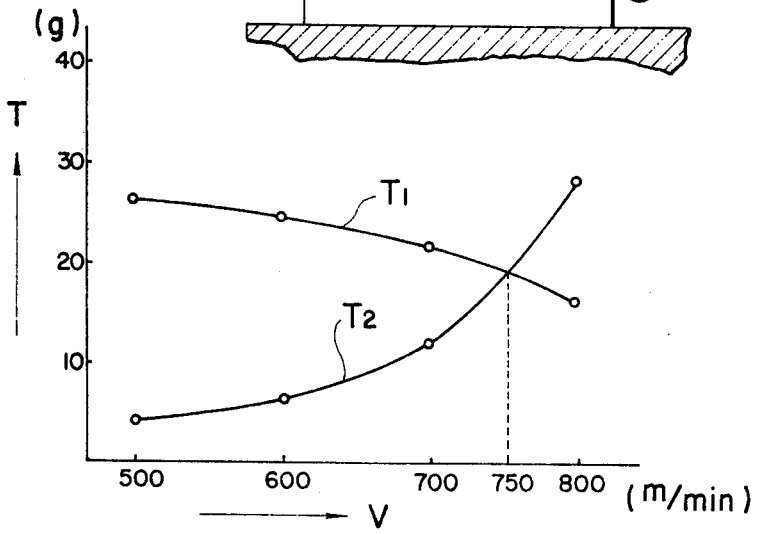
FIG. 6 is a chart showing the relationship between the feed velocity V of the filament yarn in the apparatus and the tension which is applied to this filament yarn.

According to the false twisting method of the present invention, the filament yarn 10 which is fed is caused to be nipped successively between the travelling straightly extending regions of two crossing belts 2 and 3. It is possible to adjust both the tension $T_1$ which is applied at the time of twisting, i.e. the tension applied onto the filament yarn located upstream of the nipping point and the tension $T_2$ at the time of untwisting, i.e. the tension which is applied onto the filament yarn located downstream of the nipping point not only to the condition $T_1 < T_2$, but also to the conditions $T_1 = T_2$ or $T_1 > T_2$. More specifically, in the known false twisting methods, the filament which is processed is pulled by, for example, take-up rollers in order that the filament yarn may be fed progressively from the false twisting apparatus. Therefore, the condition of the tensions applied to the filament yarn upstream and downstream of such a known apparatus is $T_1 < T_2$. This means that the twisting portion itself of such an apparatus provides hardly any feeding action or force onto the filament yarn being processed. In good contrast thereto, in the method of performing false twisting according to the present invention,, the feed action is imparted to the filament yarn by the nipping belts themselves. Therefore, by selecting the processing velocity V which means the speed with which the filament yarn is fed through the apparatus as shown in FIG. 6, it is possible to vary the relationship between $T_1$ and $T_2$ within a broad range. This fact will be explained below in further detail. FIG. 6 shows the relationship between the tension $T_1$ (gram) at the time the filament yarn is subjected to false twisting and the tension $T_2$ (gram) at the time the twisted filament yarn is untwisted, at such conditions of operation that the velocity $V_2$ of feed action which is produced naturally due to the crossing running belts is held constant at $V_2 =$ 750 m/min. and that the processing speed V is varied.

Thus, it will be understood that the relative magnitudes of the untwisting tension and the twisting tension can be varied through the range from positive to negative values. As a result, the filament yarns which are produced by the method and apparatus of the present invention can be rich in variety in their appearances depending on the conditions employed. Furthermore, even in case the filament yarn is given false twisting at a ultra-high speed which is possible with the apparatus of the present invention, there is insured a very good operability. For example, in the processing of polyester filament yarns by the apparatus of this invention, there is noted no development of hairs or fluffs in the processed filament yarns. Thus, the method and apparatus of the present invention provide extremely satisfactory advantages and effects.

Some examples of the present invention conducted under the below-mentioned conditions will hereunder be mentioned. The filament yarns which are used in these examples are those made of polyester, acryl and nylon which are the typical man-made filaments. Furthermore, in the examples is picked up acetate filament also which is the lowest in strength of all such filaments. It has been confirmed that, by subjecting these respective kinds of filament yarns to false twisting under the below-mentioned conditions, there are obtained, with no difficulty, such crimped filament yarns having external appearances exhibiting the socalled collectiveness of individual monofilaments which constitute each filament yarn. In other words, the spaces between the respective monofilaments constituting the processed filament yarn are very small, looking like a bundle. As compared with those crimped yarns obtained from known false twisting apparatuses, the crimped filament yarns produced from the false twisting apparatus of the present invention resemble very much in their external appearance those of the spun yarns. In addition, such crimped filament yarns which are obtained according to the present invention are produced at a very high speed and yet practically they are free of any "hair" or fluff formation. Such crimped filament yarns can be unwound and taken up from a cheese or cone quite smoothly.

Example 1

| material of filament yarn (No. of filament/denier) | Processing Conditions V | $V_2$ | $T_1$ | $T_2$ | $\theta$ | Temprature (° C) | Product No. of hair per 1 million m. |
|---|---|---|---|---|---|---|---|
| Polyester | | | | | | | |
| 150/32 | 384 | 450 | 72 | 12 | 90 | 260 | 0 |
| 100/24 | 357 | 500 | 47.5 | 14.5 | 90 | 260 | 0 |
| 75/36 | 357 | 400 | 50 | 20 | 90 | 270 | 0 |
| 50/24 | 530 | 550 | 40 | 4 | 90 | 250 | 0 |
| 30/24 | 590 | 600 | 24 | 7 | 90 | 230 | 0 |
| 30/12 | 700 | 750 | 18 | 4 | 90 | 250 | 0 |
| Acryl | | | | | | | |
| 150/60 | 380 | 400 | 40 | 20 | 90 | 210 | 0 |
| 100/50 | 390 | 390 | 19 | 19 | 90 | 205 | 0 |
| Nylon | | | | | | | |
| 100/24 | 600 | 700 | 72 | 1 | 90 | 190 | 0 |
| 70/16 | 600 | 700 | 52 | 1.5 | 90 | 190 | 0 |
| 70/34 | 700 | 800 | 60 | 2-3 | 90 | 210 | 0 |

Example 1-continued

| material of filament yarn (No. of filament/denier) | Processing Conditions V | $V_2$ | $T_1$ | $T_2$ | $\theta$ | Temperature (° C) | Product No. of hair per 1 million m. |
|---|---|---|---|---|---|---|---|
| 40/34 Acetate | 800 | 850 | 33 | 3 | 90 | 190 | 0 |
| 100/26 | 340 | 400 | 12 | 10 | 90 | 205 | 5 |

Next, some examples which are conducted under the condition $T_1 < T_2$ will be mentioned as follows.

Example 2

| Material of filament yarn (No. of filament/denier) | Processing Conditions V | $V_2$ | $T_1$ | $T_2$ | $\theta$ | Temperature (° C) | Product No. of hair per 1 million m. |
|---|---|---|---|---|---|---|---|
| Polyester | | | | | | | |
| 100/24 | 570 | 500 | 25 | 45 | 90 | 230 | 6 |
| 50/24 | 530 | 450 | 20 | 40 | 90 | 220 | 5 |
| 50/24 | 550 | 450 | 14 | 45 | 90 | 220 | 103 |

As will be apparent from the afore-mentioned examples 1 and 2, it is desirable to set the operation condition of $T_2/T_1 < 2.0$ in order to suppress the development of hair or fluffs in the crimped filament yarn produced. The condition of $T_2/T_1 \leqq 1.0$ is preferable, and still more precisely, the condition of $0.005 \leqq T_2/T_1 \leqq 1.0$ is more preferred.

Figure 7:
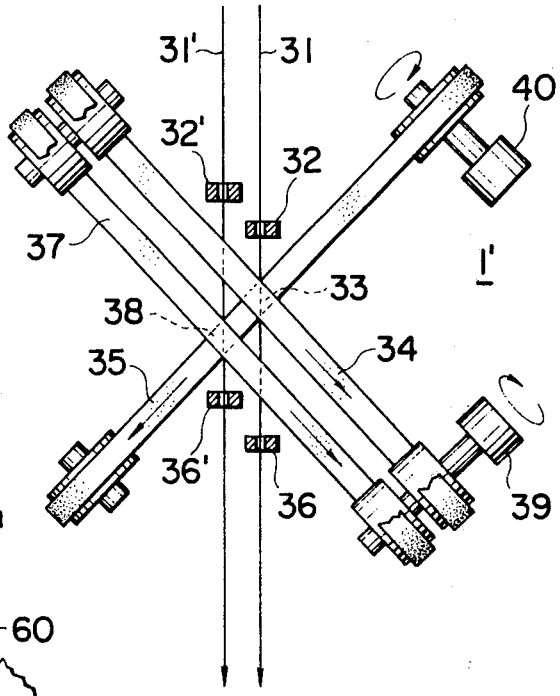
FIG. 7 is a somewhat diagrammatic representation of the essential portions of the false twisting apparatus representing a modification of the present invention.

FIG. 7 is a front view showing an example of the operation of subjecting two filament yarns to false twisting simultaneously in a single same false twisting apparatus, so that this example will serve as the second embodiment of the present invention. In exactly the same way as in the first embodiment described above, a first filament yarn 31 is fed via an inlet guide 32 onto a first crossing zone 33 of the straightly extending region of a belt 34 and the straightly extending region of another belt 35 so as to be subjected to false twisting process as this first filament yarn 31 is twisted successively of its length in this first crossing zone 33, i.e. between the running two contacting work surfaces of these two straightly extending regions of the two belts 34 while being nipped succesively therebetween. The filament yarn 31 is forced to emerge from said first crossing zone 33 due to the feeding action produced by the crossing work surfaces of the two belts, and it passes through an outlet guide 36. In addition to this first filament yarn 31, it should be noted that a second filament yarn 31' is fed via another inlet guide 32' onto a second crossing zone 38 of the straightly extending region of a belt 37 which is arranged by the side of the straightly extending region of the belt 34 in spaced parallel relationship therewith and the straightly extending region of the belt 35 so as to be subjected to false twisting process at the same time with the first filament yarn 31 as this second filament yarn 31' is twisted successively of its length in this second crossing zone 38, in exactly the same fashion as the first filament yarn 31 is twisted in the first crossing zone 33, while being successively nipped between the two work surfaces of the two belts 35 and 37. Owing to the feeding action produced in this second crossing zone 38, the second filament yarn 31' emerges therefrom and passes through an outlet guide 36'.

It should be understood that, in FIG. 7, there may be provided an appropriate number of additional belts besides the belts 34 and 37 in such a manner that all these belts are driven by a drive pulley 39 which, in FIG. 7, is shown to drive the two belts 34 and 37. By so arranging, a plurality more of filament yarns in addition to said first and second filament yarns 31 and 31' can be subjected to false twisting process simultaneously with said first and second filament yarns. Similarly, in addition to the belt 35 which is driven by a drive pulley 40, there may be arranged an appropriate number of additional belts so that a number of filament yarns may be subjected to twisting at the same time.

Figure 8:
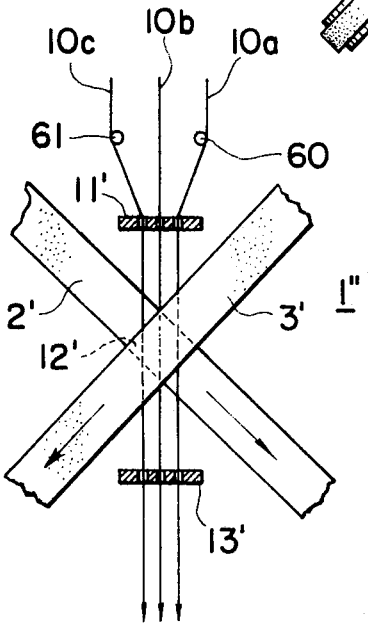
FIG. 8 is a somewhat diagrammatic representation of the essential portions of the false twisting apparatus, showing another modification of the present invention.

Also, FIG. 8 shows another embodiment of the present invention. In this embodiment, the general arrangement of the false twisting apparatus indicated generally at 1', with the supporting members and the drive members being omitted for the sake of simplicity, is similar to that shown in FIG. 1. However, the belts 2' and 3' are of a much broader width, respectively, and accordingly the pulleys 4 and 7 therefor are of correspondingly broader belt-supporting portions circumferentially thereof. As shown, there are fed three filament yarns **10*a*, 10*b* and 10*c* onto the false twisting zone 12'. The two filament yarns 10*a* and 10*c* which are fed on both sides of a central filament 10*b* are led to outer slits of an inlet guide 11' via guide rollers 60 and 61, whereas the central filament yarn 10*b* advances straightwardly to the central slit of the inlet guide 11'. Therefrom these three filament yarns 10*a*, 10*b* and 10*c* are fed to the broad crossing zone 12' where the three filament yarns are subjected simultaneously to false twisting process successively of their lengths while being nipped successively between the broad work surfaces of the straightly extending regions of the two belts 2' and 3'** which run in different directions relative to each other. Thus, a plurality of filament yarns can be subjected to false twisting process simultaneously by the use of belts having substantially broad widths of the work surfaces.

Figure 9:
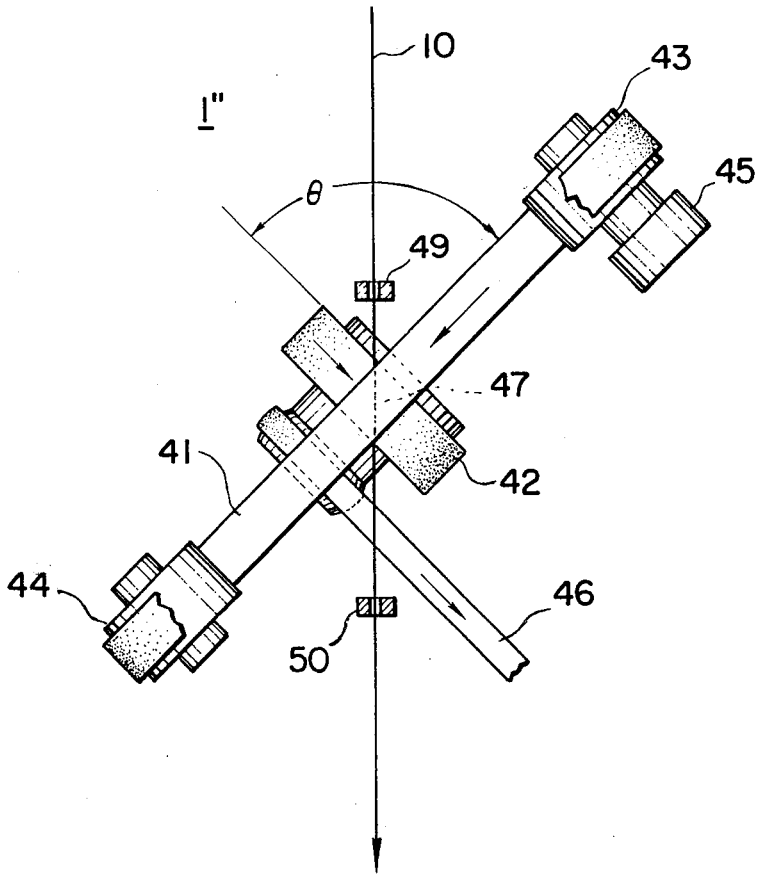
FIG. 9 is a somewhat diagrammatic representation of the essential portions of the false twisting apparatus, showing still another modification of the present invention.

FIG. 9 shows still another embodiment of the present invention. More specifically, there is shown the essential part of the false twisting apparatus 1'' comprising a combination of one endless belt 41 and a roller 41. This endless belt 41 is supported on pulleys 43 and 44 in such a manner that its straightly extending region between these two pulleys is arranged at an angle $\theta$ relative to the direction of radius of the roller 42 as viewed from above the sheet of FIG. 9. This belt 41 is driven by a drive pulley 45 so as to run in the direction of the arrow mentioned. On the other hand, the roller 42 is driven by a drive belt 46. The straightly extending region of the belt 41 is arranged to be in contact with a part of the entire circumferential surface of the roller 42 at the crossing zone 47. A filament yarn 10 which is to be subjected to a false twisting process is fed through a heater not shown provided upstream of the false twisting apparatus 1" and it is passed through an inlet guide 49 to be fed into the crossing zone 47 where the filament yarn 10 is twisted while being nipped between the contacting work surfaces of the straightly extending region of the belt 41 and a part of the entire circumference of the roller 42 successively. Therefrom the filament yarn 10 is forced to emerge onto an outlet guide 50 to be taken up. Thus, the same effect of false twist is imparted to the filament yarn 10 as in the preceding embodiments.

As has been discussed above with respect to some preferred embodiments of the present invention, it will be noted that according to the method and the apparatus of the present invention, the filament yarn which may be in plural number is given false twist while being nipped either between two contacting crossed work surfaces of straightly extending regions of two or more belts running in crossing relationship or between a part of the circumference of a roller rotating in a certain direction and the work surface of the straightly extending region of a belt running in a different direction and contacting the part of said circumference successively and while at the same time therewith being urged to advance successively from the crossing zone of the successively contacting work surfaces. Known false twisting methods utilizing friction require the use of twister members having a high friction coefficient in order to maintain the effect of twisting. However, when the running work surfaces of a high friction are brought into contact with each other successively, there is generated heat therebetween so that these work surfaces tend to become sticky more and more and the life of these friction members becomes short. Also, in case false twister belts become sticky, the running of such belts become unstable due to vibrations of the belts, and in worst cases, the belts may slip off the pulleys which support the belts when the pressure of contact between the work surfaces of these belts is increased. According to the method and the apparatus of the present invention, the work surfaces of the twister members are of a relatively small friction coefficient therebetween since the belts are made of a synthetic rubber. Thus, there can be obtained proper effect of false twisting without the occurrence of undesirable excessive generation of heat and stickiness. Besides, the present invention is free of the drawback represented by a difficulty in effecting fine adjustment of the pressure of contact of the two twister members such as rotating disks which are brought into contact with each other successively at one point of their circumferences. The angle between the contacting twister members can be altered as desired depending on the type of the filament yarns to be processed and on other conditions employed.

I claim:

1. A false twisting method of nipping type for producing crimped filament yarns, comprising arranging at least two power-driven twister members having work surfaces of a relatively small friction coefficient therebetween in such a manner that these work surfaces successively cross each other in contact relationship at a selected angle to provide a crossing zone successively between these work surfaces, and feeding at least one filament yarn through said crossing zone to thereby subject said filament yarn to false twisting while nipping this filament yarn between said successively contacting work surfaces and urging, at the same time therewith, this filament yarn to advance successively from said crossing zone.

2. A false twisting method according to claim 1, wherein said twister members are driven so that their work surfaces run at a same surface speed.

3. A false twisting method according to claim 1, in which said at least two power-driven twister members are endless belts made of synthetic rubber and having substantially flat work surfaces and applied to two sets of power-driven pulleys to provide straightly extending regions between each set of these pulleys.

4. A false twisting method according to claim 1, in which: said at least two power driven twister members are comprised of one endless belt made of a synthetic rubber having a substantially flat work surface and having a straightly extending region between its pulleys, and a roller having its work surface made of a synthetic rubber.

5. A false twisting method according to claim 1, in which: the feeding speed of said filament yarn through the apparatus is selected relative to the urging speed produced naturally by the successive crossing of the contacting work surfaces, so as to establish the condition $T_2/T_1 < 2.0$ wherein $T_1$ represents the tension applied to said filament yarn located upstream of the nipping point in said crossing zone where it is subjected to false twisting and $T_2$ represents the tension applied to this filament yarn located downstream of said nipping point in said crossing zone where this filament yarn is left to unwind.

6. A false twisting method according to claim 1, in which: the feeding of said filament yarn is selected relative to the urging speed produced naturally by the successive crossing of the contacting work surfaces, so as to establish the condition $T_2/T_1 \leqq 1.0$ wherein $T_1$ represents the tension applied to said filament yarn located upstream of the nipping point in said crossing zone and $T_2$ represents the tension applied to this filament yarn located downstream of said nipping point in said crossing zone where this filament yarn is left to unwind.

7. A false twisting method according to claim 1, in which: the feeding speed of said filament yarn is selected relative to the urging speed produced naturally by the successive crossing of the contacting work surfaces, so as to establish the condition $0.005 \leqq T_2/T_1 \leqq 1.0$ wherein $T_1$ represents the tension applied to said filament yarn located upstream of the nipping point in said crossing zone and $T_2$ represents the tension applied to this filament yarn located downstream of said nipping point in said crossing zone where this filament yarn is left to unwind.

8. A false twisting method according to claim 1, in which: the pressure of contact between the work surfaces of the twister members is set at 300 grams or smaller.

9. A false twisting method according to claim 5, in which: the pressure of contact between the work surface of the twister members is set at 300 grams or smaller.

10. A false twisting method according to claim 6, in which: the pressure of contact between the work surfaces of the twister members is set at 300 grams or smaller.

11. A false twisting method according to claim 7, in which: the pressure of contact between the work surfaces of the twister members is set at 300 grams or smaller.

12. A false twisting apparatus of nipping type for producing crimped filament yarns, comprising:

power-driven at least one first twister member having a work surface and power-driven at least one second twister member having a work surface, both of said first and second twister members being arranged so that their work surfaces cross each other at a predetermined angle in contact relationship to provide a crossing zone for nipping at least one filament yarn fed into this crossing zone to twist this filament yarn between the contacting work surfaces and at the same time therewith to urge this filament yarn to advance from said crossing zone, and means for driving said first and second twister members so that the work surfaces of the first and second twister members run in different directions relative to each other at a predetermined angle.

13. A false twisting apparatus according to claim 12, in which: said driving of said first and second twister members is conducted so that the respective work surfaces run at a same surface speed.

14. A false twisting apparatus according to claim 12, in which: said at least one first twister member is at least one endless belt made of a synthetic rubber and having substantially flat work surface and applied between two power-driven pulleys to provide a straightly extending region therebetween, and said at least one second twister member is at least one endless belt made of a synthetic rubber and having substantially flat work surface and applied between another two power-driven pulleys to provide a straightly extending region therebetween.

15. A false twisting apparatus according to claim 12, further comprising: means for altering said angle of crossing of the work surfaces of the first and second twister members as required.

16. A false twisting apparatus according to claim 12, in which: the work surfaces of the first and second twister members are made with material having a relative small friction coefficient therebetween.

17. A false twisting apparatus according to claim 16, in which: said friction coefficient is 0.5 or smaller.

18. A false twisting apparatus according to claim 16, in which: said friction coefficient $\mu$ is $0.1 < \mu < 0.4$.

19. A false twisting apparatus according to claim 16, in which: said friction coefficient $\mu$ is $0.2 < \mu < 0.3$.

20. A false twisting apparatus according to claim 14, in which: at least one filament yarn is fed into at least two said crossing zones, respectively defined by at least one straightly extending region of said first endless belt crossing in contact with at least two straightly extending regions of at least two second endless belts arranged side by side in parallel with each other.

21. A false twisting apparatus according to claim 12, in which:

said at least first twister member is an endless belt having a substantially flat work surface and applied between two power-driven pulleys and said at least one second twister member is a roller having a work surface formed circumferentially thereof, said roller being arranged so that its circumferential work surface crosses the work surface of said belt in contact relationship at a predetermined angle relative to each other to provide a crossing zone for nipping at least one filament yarn fed into this crossing zone to twist this filament yarn between the contacting work surfaces and at the same time therewith to urge this filament yarn to advance from said crossing zone, and means for driving said first and second twister members so that the work surfaces of the first and second twister members run in different directions relative to each other.

22. A false twisting method according to claim 1, wherein said small friction co-efficient is 0.5 or less.

23. A false twisting method according to claim 22, wherein said small friction co-efficient is between 0.1 and 0.4.

24. A false twisting method according to claim 23, wherein said small friction co-efficient is between 0.2 and 0.3.

* * * * *